US005580026A

United States Patent [19]

Newcomer

[11] Patent Number: 5,580,026

[45] Date of Patent: Dec. 3, 1996

[54] TREE STAND

[76] Inventor: Charles H. Newcomer, P.O. Box 134, Grants Pass, Oreg. 97526

[21] Appl. No.: 353,900

[22] Filed: Dec. 12, 1994

Related U.S. Application Data

[63] Continuation-in-part of Ser. No. 29,846, Oct. 17, 1994, Pat. No. Des. 366,008.

[51] Int. Cl.[6] ..... F16M 13/00

[52] U.S. Cl. ..... 248/523; 248/527; 411/104

[58] Field of Search ..... 248/519, 523, 248/524, 527; 411/104, 105, 974; D11/130.1; 47/40.5

[56] References Cited

U.S. PATENT DOCUMENTS

| | | | |
|---|---|---|---|
| D. 123,889 | 12/1940 | Moldowan | D11/130.1 |
| D. 172,007 | 4/1954 | Cousland | D11/130.1 |
| D. 287,476 | 12/1986 | Craft et al. | D11/130.1 |
| D. 351,570 | 10/1994 | Fillipp | D11/130.1 |
| 2,613,899 | 10/1952 | Wagner et al. | 248/527 X |
| 2,847,175 | 8/1958 | Farley et al. | 47/40.5 |
| 2,905,414 | 9/1959 | Zierden | 248/527 X |
| 5,000,414 | 3/1991 | Rosato | 248/524 |
| 5,022,804 | 6/1991 | Peterson | 411/104 |
| 5,193,643 | 3/1993 | McIntyre | 411/104 X |
| 5,301,462 | 4/1994 | Hronyetz | 47/40.5 |
| 5,320,323 | 6/1994 | Clark, Jr. | 248/523 |
| 5,425,199 | 6/1995 | Sofy | 248/523 X |

OTHER PUBLICATIONS

Playthings Magazine; Sep. 1960; p. 117; Revolving Tree Stand (lower, center).

*Primary Examiner*—Korie Chan
*Attorney, Agent, or Firm*—Jerry T. Kearns

[57] ABSTRACT

A tree stand intended principally for use with a natural Christmas tree includes a substantially hollow frusto conical base portion having a plurality of stepped frusto conical surfaces terminating at an upper end in a cylindrical double-walled well dimensioned for receipt of a trunk portion of a tree. Four circumferentially spaced set screw receiving apertures extend through inner and outer walls of the well. A pair of radially extending bulkheads extend between the inner and outer side walls and include juxtaposed slots mounting edge portions of threaded wafer nuts for engagement with pointed set screws. In use, a user tightens the set screws into engagement with a trunk portion of a tree to centrally secure the same in the cylindrical central well. A metal spike extends centrally upwardly from a floor of the well, reinforced by diametrically and circumferentially extending struts and webs, for engagement into a cut end portion of a tree. The tree stand is preferably integrally molded from a plastic material.

7 Claims, 4 Drawing Sheets

TREE STAND

CROSS-REFERENCE TO RELATED APPLICATIONS

This is a continuation-in-part of U.S. Design application Ser. No. 29/029,846, filed Oct. 17, 1994, now U.S. Pat. No. Des. 366,008 the entire disclosure of which is hereby incorporated by reference herein.

BACKGROUND OF THE INVENTION

The present invention relates to tree stands, and more particularly pertains to an improved tree stand of the type employed to support Christmas trees.

SUMMARY OF THE INVENTION

A tree stand intended principally for use with a natural Christmas tree includes a substantially hollow frusto conical base portion having a plurality of stepped frusto conical surfaces terminating at an upper end in a cylindrical double-walled well dimensioned for receipt of a trunk portion of a tree. Four circumferentially spaced set screw receiving apertures extend through inner and outer walls of the well. A pair of radially extending bulkheads extend between the inner and outer side walls and include juxtaposed slots mounting edge portions of threaded wafer nuts for engagement with pointed set screws. In use, a user tightens the set screws into engagement with a trunk portion of a tree to centrally secure the same in the cylindrical central well. A metal spike extends centrally upwardly from a floor of the well, reinforced by diametrically and circumferentially extending struts and webs, for engagement into a cut end portion of a tree. The tree stand is preferably integrally molded from a plastic material.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figure 1:
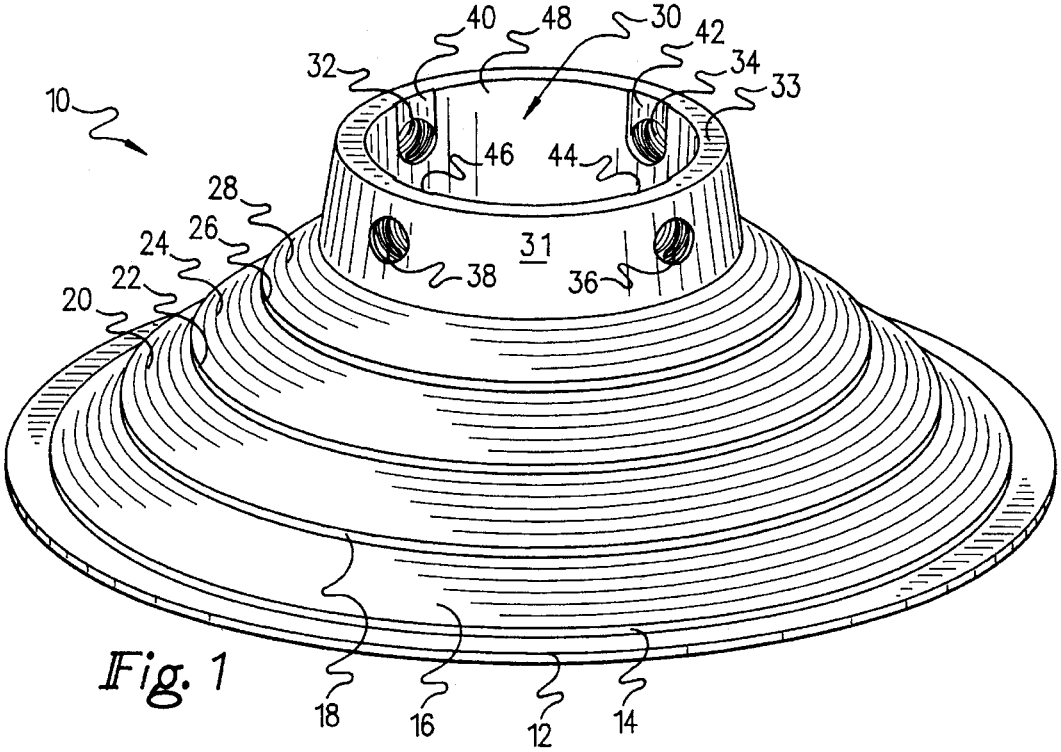
FIG. 1 is a front top perspective view of a tree stand according to the present invention.

Referring now to the drawings, wherein like reference numerals designate corresponding structure throughout the views, and referring in particular to FIGS. 1 through 6, an improved tree stand 10 according to a preferred embodiment of the invention comprises a generally conical base member including a radially outermost circular flange 12 adapted and disposed for abutment with a planar surface such as a floor or tabletop. The flange 12 preferably has a maximum diameter or width W (FIG. 3) of about 20.5 inches. The base includes a plurality of frusto conically tapered steps 16, 20, 24, and 28 separated by a plurality of circular circumferentially extending ridges 14, 18, 22, and 26.

Figure 3:
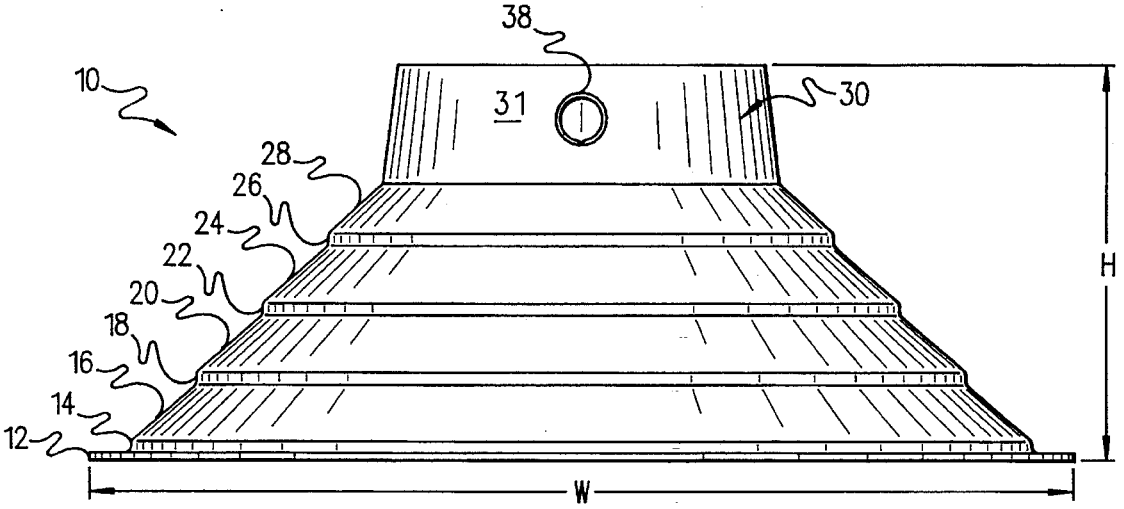
FIG. 3 is a representative side elevational view thereof.

The tree stand 10 terminates at an upper end in an open circular socket or well 30 including a plurality of evenly circumferentially spaced circular apertures 32, 34, 36, and 38 adapted for the receipt of threaded set screws for the purpose of securing a trunk portion of a natural tree within the well or socket 30. Flattened regions 40, 42, 44, and 46 correspond with the angular positions of the respective apertures 32, 34, 36, and 38. The stand 10 preferably has a height H of about 8.5 inches (FIG. 3).

Figure 2:
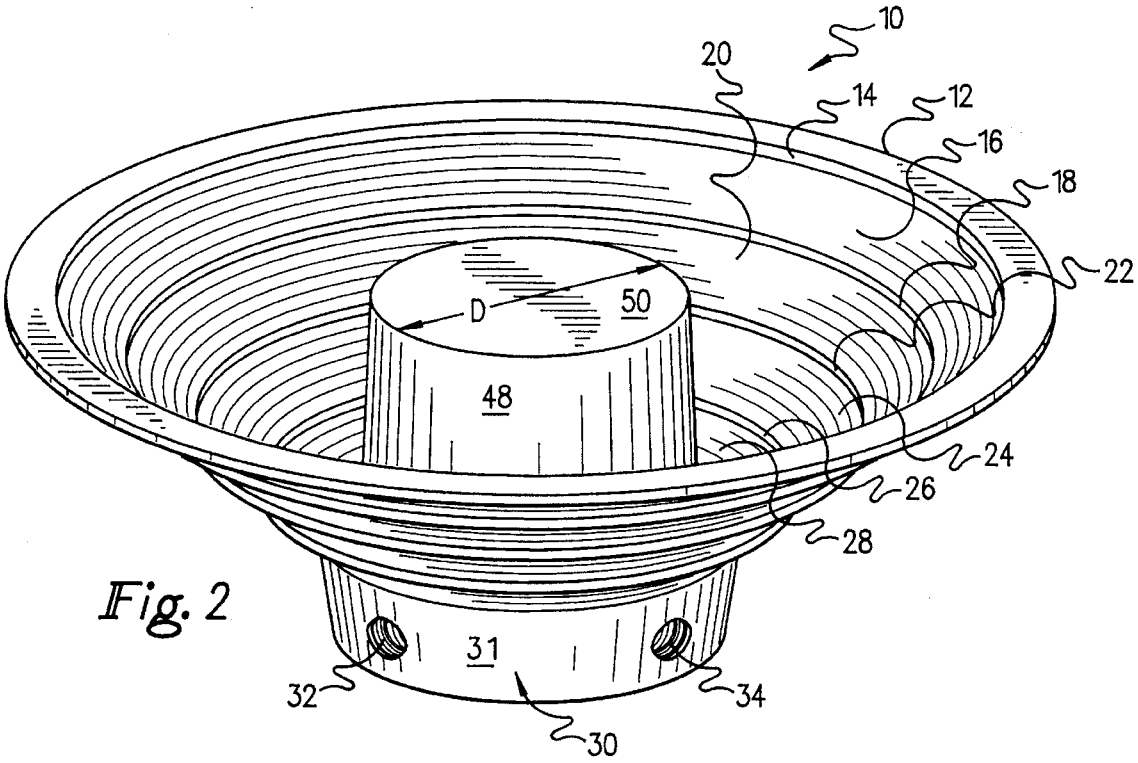
FIG. 2 is a bottom perspective view thereof.
Figure 5:
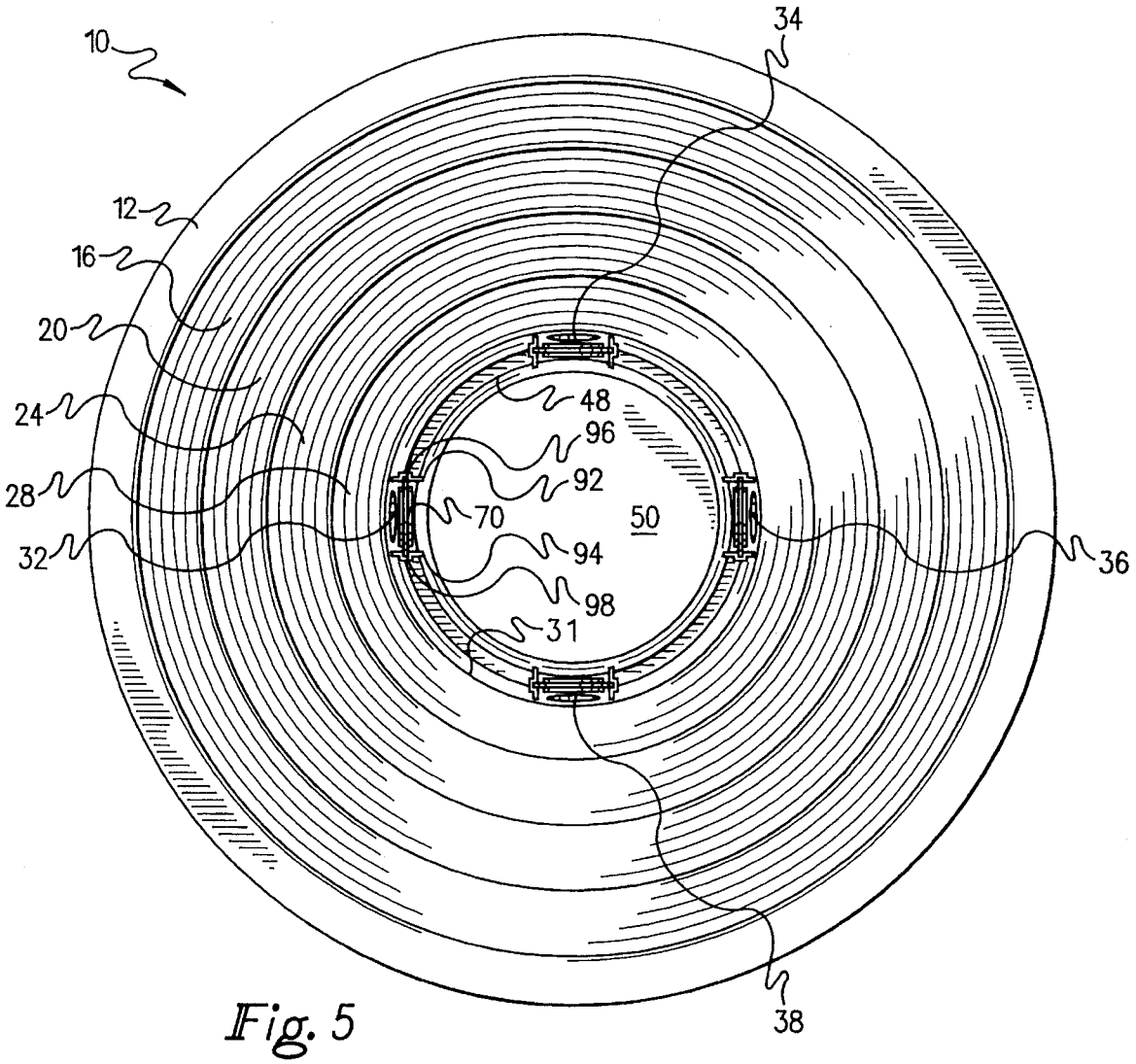
FIG. 5 is a bottom plan view thereof.

As can be appreciated from FIGS. 1, 2, and 5, the well or socket 30 includes at an upper end thereof a double wall construction having an outer substantially cylindrical wall 31 and an inner cylindrical wall 48 connected at an upper end of the tree stand 10 by a circular rim 33. The well or socket 30 includes a floor or bottom portion 50 having a substantially planar circular shape with a preferred diameter D of about 6.25 inches, as best shown in FIG. 2. Lowermost surfaces of the floor 50 and flange 12 preferably lie in a common horizontal plane to provide stability and rigidity to the stand 10 by concurrent abutment with a floor or other supporting surface.

Figure 4:
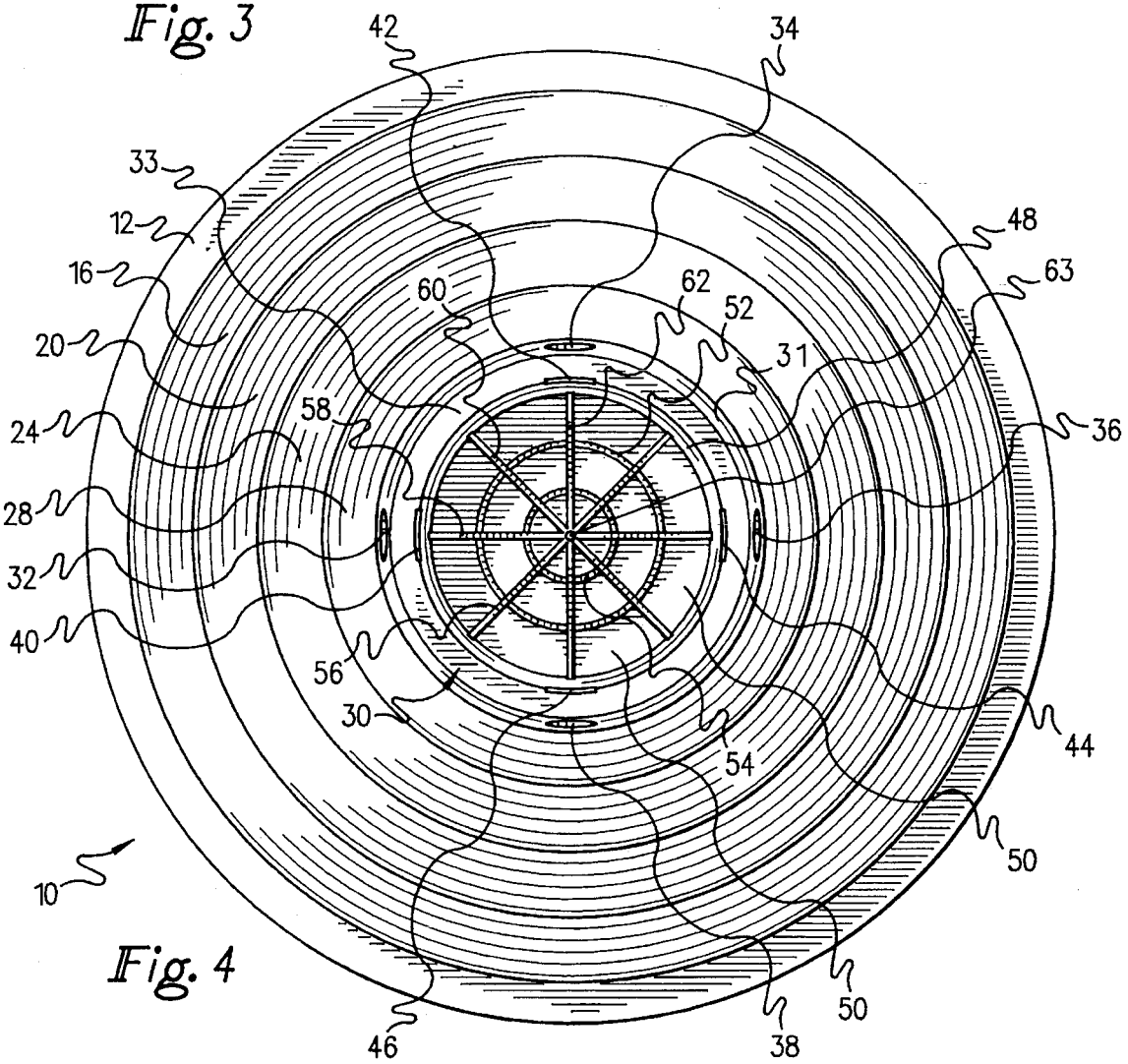
FIG. 4 is a top plan view thereof.

A plurality of coaxial circular reinforcing webs 52 and 54 extend slightly upwardly from an interior surface of the well floor 50, as shown in FIG. 4. A plurality of evenly circumferentially spaced diametrically extending reinforcing struts 56, 58, 60, and 62 intersect the circular webs 52 and 54 and intersect one another at a central intersection. A metal locating spike 63 extends centrally upwardly from the floor 50 of the well 30 for the purpose of engagement with a central bottom end portion of a severed natural tree trunk.

Figure 6:
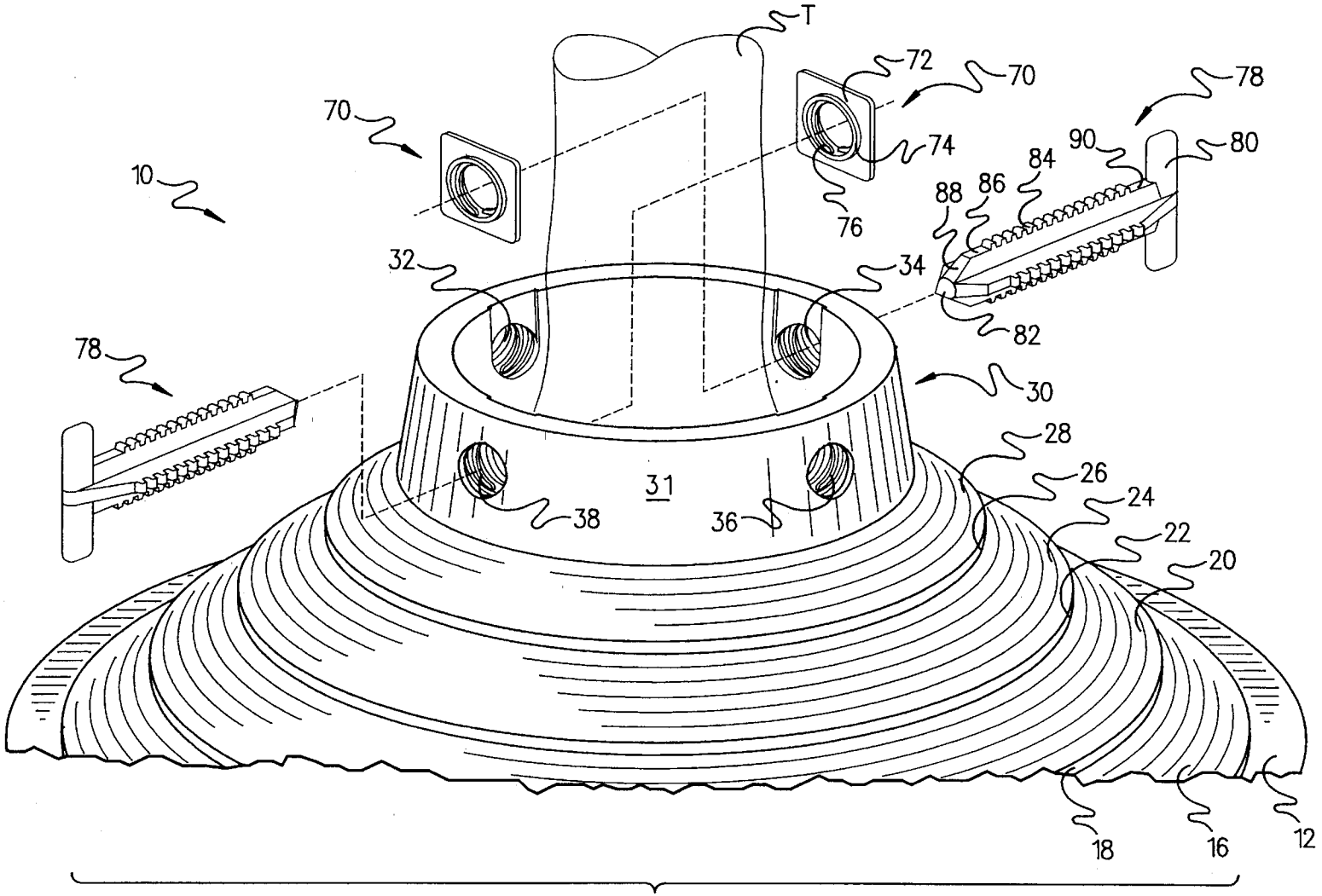
FIG. 6 is an exploded perspective detail view illustrating the threaded fastener components of the tree stand according to the present invention.

With reference to FIG. 6, each of the apertures 32, 34, 36, and 38 receive therein a wafer-like nut 70 including a generally square body portion 72 having a central cylindrical barrel region 74 provided within an internal thread 76. Thus, each of the apertures in reality comprises a pair of coaxial circular holes formed through the outer 31 and inner 48 walls of the well 30, with a nut 70 disposed coaxially therebetween in a manner to be described subsequently.

Each of the apertures 32, 34, 36, and 38 receive a set screw 78 for the purpose of securing and retaining a trunk portion T of a natural Christmas tree in a vertically upright manner within the well 30. Inasmuch as each of the set screws 78 are identically formed, a description of one will suffice to provide an understanding of all. Accordingly, each of the set screws 78 includes a transverse handle bar portion 80 and an oppositely disposed pointed tip region 82. The body of the set screw 78 includes four circumferentially evenly disposed land regions, each of which include an axially forwardly and radially inwardly inclined end facet portion 88 merging with the tip region 82. A planar axially extending facet portion 86 adjoins a forward end portion of a threaded region 84 connected by a trailing planar facet 90 to the handle bar 80. Each of the four lands of the set screw 78 is formed in a similar manner. Thus, the four land regions of the screw 78 form an interrupted thread readily engaged with corresponding threads and of sufficient strength yet not requiring great precision in manufacture.

With reference to FIG. 5, each of the apertures 32, 34, 36, and 38 include a pair of spaced substantially radially extending bulkheads 92 and 94 provided with respective axially extending slots 96 and 98 dimensioned and disposed for press fit insertion of side edge portions of wafer nuts 70. The bulkheads 92 and 94 extend within the hollow annular space formed by the outer cylindrical wall 31 and the inner cylindrical wall 48 of the well 30. Accordingly, the bulkheads perform the dual function of mounting the wafer nuts for threaded engagement with the set screws 78, and also serve to provide structural bracing to the hollow annular region of the tree stand 10.

In a manner of use of the tree stand 10 according to the present invention, an individual places a trunk portion T of a natural Christmas tree within the hollow interior portion of the well or socket 30 with sufficient force to engage the central spike 63 (FIG. 4) into the cut bottom end surface of the trunk T. The user then installs four of the set screws 78 through respective apertures 32, 34, 36, and 38, and consequently into threaded engagement with the wafer nut 70 associated with each of the aforesaid apertures. The user then tightens the set screws 78 evenly to centrally and firmly retain and secure the trunk T within the central region of the well or socket 30. A user may then also add water within the well 30 to prevent dehydration of the cut tree.

The entire tree stand 10 according to the present invention, excepting screws 78 and nuts 70, is preferably integrally molded from a plastic material which may be ornamentally decorated or pigmented. For example, the tree stand 10 may preferably be molded from a green plastic material. The wafer nuts 70 and the set screws 78 are preferably molded separately from the tree stand 10 and may be readily secured thereto, either at the factory, or by a user. For example, with reference to FIG. 5, the wafer nuts 70 may be easily slipped into the slots 96 and 98 of the bulkheads 92 and 94 by a user.

The stepped frusto conical configuration of the tree stand 10 according to the present invention provides a high degree of rigidity and stability, while at the same time being of a substantially hollow construction and thus utilizing a minimum of plastic material in its formation. In this manner, the tree stand 10 of the present invention may be manufactured in an economical manner.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A tree stand, comprising:

a substantially hollow frustoconical base including a plurality of steps tapering from a widest base portion including an outermost circular flange dimensioned and disposed for abutment with a supporting surface to an upper portion including a well dimensioned for insertion of a trunk portion of a tree, each of said adjacent pair of said steps separated by a circular circumferentially extending upstanding cylindrical ridge;

said well terminating at a lower end in a floor dimensioned and disposed for abutment with said supporting surface;

a plurality of circular webs and centrally intersecting struts upstanding from said floor of said well;

said base and said well integrally molded from a plastic material;

a spike member upstanding from a central portion of said floor for engagement with the cut end portion of the trunk portion of a tree;

said well including an upper portion having a double wall construction including an inner substantially cylindrical wall and an outer substantially cylindrical wall;

a plurality of circumferentially spaced apertures extending through said inner and outer walls; and a pair of spaced bulkheads extending radially between and structurally bracing said inner and outer walls associated with each of said circumferentially spaced apertures, said bulkheads including juxtaposed axially extending slots retaining edge portions of a substantially rectangular nut having a central cylindrical barrel portion provided with an internal thread disposed coaxially with said apertures extending through said inner and outer walls for engagement with a threaded fastener for retaining the trunk portion of the tree in said well.

2. In a tree stand, including a well dimensioned for receiving a trunk portion of a tree, the improvement comprising:

said well including an upper portion having a double wall construction including an inner substantially cylindrical wall and an outer substantially cylindrical wall;

a plurality of circumferentially spaced apertures extending through said inner and outer walls; and a pair of spaced bulkheads extending radially between and structurally bracing said inner and outer walls associated with each of said circumferentially spaced apertures, said bulkheads including juxtaposed axially extending slots retaining edge portions of a substantially rectangular nut having a central cylindrical barrel portion provided with an internal thread disposed coaxially with said apertures extending through said inner and outer walls for engagement with a threaded fastener for retaining the trunk portion of a tree in said well.

3. The tree stand of claim 2, further comprising:

a substantially hollow frustoconical base including a plurality of steps tapering from a widest base portion including an outermost circular flange dimensioned and disposed for abutment with a supporting surface to an upper portion including said well, each of said adjacent pair of said steps separated by a circular circumferentially extending upstanding cylindrical ridge.

4. The tree stand of claim 3, wherein said tree stand comprises an integrally molded plastic construction.

5. The tree stand of claim 2 wherein said well terminates at a lower end in a floor dimensioned and disposed for abutment with a supporting surface.

6. The tree stand of claim 5, further comprising a plurality of circular webs and centrally intersecting struts upstanding from said floor of said well.

7. The tree stand of claim 5, further comprising a spike member upstanding from a central portion of said floor for engagement with a cut end portion of the trunk portion of the tree.

* * * * *